US005855038A

United States Patent [19]

Dispense

[11] Patent Number: 5,855,038

[45] Date of Patent: Jan. 5, 1999

[54] PICNIC TABLE MOVING APPARATUS

[76] Inventor: Joseph H. Dispense, 2979 E. Main Rd., Dunkirk, N.Y. 14048

[21] Appl. No.: 946,291

[22] Filed: Oct. 7, 1997

[51] Int. Cl.[6] ..... B60B 33/06

[52] U.S. Cl. ..... 16/34

[58] Field of Search ..... 16/34, 30, 32, 16/33; 280/43.14, 43.24; 248/188.2, 188.6

[56] References Cited

U.S. PATENT DOCUMENTS

| | | | |
|---|---|---|---|
| 1,014,440 | 1/1912 | Benskin | 16/34 |
| 2,774,986 | 12/1956 | Moorehouse | 16/34 |
| 2,848,229 | 8/1958 | Miller . | |
| 3,514,154 | 5/1970 | Kotler . | |
| 3,616,474 | 11/1971 | Lindblad . | |
| 3,831,211 | 8/1974 | Bustamante . | |
| 4,040,658 | 8/1977 | Mayol . | |
| 4,076,305 | 2/1978 | Sullivan . | |
| 4,615,534 | 10/1986 | Blain . | |
| 4,706,983 | 11/1987 | Griswold . | |
| 4,974,284 | 12/1990 | Campbell . | |
| 5,154,265 | 10/1992 | Capistrant | 16/34 |
| 5,586,803 | 12/1996 | Overpeck | 16/32 |

*Primary Examiner*—Chuck Y. Mah

*Attorney, Agent, or Firm*—The Bilicki Law, P.C.

[57] ABSTRACT

A retractable wheel assembly for moving an object having a vertical surface for attachment of the wheel assembly, comprising a plurality of arms, each arm having a wheel at one end, a plurality of pivot assemblies for receiving the arms such that when the pivot assemblies are attached to the object, the arms pivot in a vertical plane about the pivot assembly, mounting means for attaching the pivot assemblies to the object, and means for locking the wheel assembly in a retracted position wherein the weight of the wheel assembly maintains the wheel assembly in the retracted position, and for locking the wheel assembly in an extended position wherein the weight of the object maintains the wheel assembly in the extended position.

6 Claims, 7 Drawing Sheets

PICNIC TABLE MOVING APPARATUS

FIELD OF THE INVENTION

This invention relates generally to an apparatus for moving objects over short distances. More specifically, it relates to a retractable wheel assembly attached to an object that is easy to use and retract.

BACKGROUND OF THE INVENTION

Typically, moving of heavy or bulky objects over short distances requires the objects to be lifted or dragged to the desired position. This often necessitates the involvement of two or more people. An example of an object that frequently requires movement over short distances and that is too bulky for one person to move and difficult to drag is a picnic table. Previously, others have attempted to attach wheels in various ways to facilitate the movement of objects.

Permanently attached wheels have been described for picnic tables and boats. U.S. Pat. No. 4,974,284 (Campbell) describes a wheel assembly consisting of wheels attached to the opposite legs of a picnic table. The wheels operate independently of each other and are not retractable. U.S. Pat. No. 2,848,229 (Miller) discloses a combination sand box and table. The table is equipped with a pair of wheels fixed to two legs. Again, the wheels are not retractable. U.S. Pat. No. 5,586,803 (Overpeck) discloses a movable picnic table having a pair of wheels mounted to a pair of legs. Foot brackets are attached to the other pair of legs to match the height increase due to the wheels on one pair of legs. The wheels are permanently attached to the legs and are not retractable. U.S. Pat. No. 3,514,154 (Kotler) discloses a folding picnic table having wheels attached to two legs. While the picnic table itself can be folded, the wheels are not retractable.

Foldable assemblies have also been described previously. Such assemblies generally require the insertion or removal of some parts for folding the assembly. U.S. Pat. No. 4,706,983 (Griswold) discloses a retractable wheel assembly used in towing a boat. A leaf spring support pivots about a pin. Another pin, which is removable, secures the leaf spring support to a channel. In order for the assembly to be retracted, the pin has to be manually removed. The pin is inserted back to lock the leaf spring in place for moving the boat. U.S. Pat. No. 4,615,534 (Blain) discloses a movable, foldable wheel support for boats. The foldable wheel support has a pin fitting on to two notches to hold the support in an extended position. The invention employs a closed loop system for raising and lowering of the wheel assembly. The support is folded by pulling upwards a rope loop secured to the support. The support is held in the folded position by securing the rope loop to a swivel attached to the boat. U.S. Pat. No. 3,616,474 (Lindblad), U.S. Pat. No. 3,831,211 (Bustamante), and U.S. Pat. No. 4,040,658 (Mayol) disclose retractable wheel assemblies in which positioning of the wheel in an extended or retracted position is achieved by inserting a removable pin.

Still others have disclosed devices that can be attached at the time of need. U.S. Pat. No. 4,076,305 (Sullivan) discloses a knock-down mobile picnic table and bench assembly having a wheel assembly that is not retractable. The wheels are kept separately and added to the assembly only after it has been stacked for transport.

Thus, while several wheel assemblies are known in the literature, most of the assemblies are either not retractable or require manipulation of parts for retraction. Therefore a need exists for an apparatus for moving objects like picnic tables over short distances, that is simple and easy to use.

SUMMARY OF THE INVENTION

This invention broadly comprises a retractable wheel assembly for moving an object having a vertical surface for attachment of the wheel assembly, comprising a plurality of arms, each arm having a wheel at one end; a plurality of pivot assemblies for receiving the arms such that when the pivot assemblies are attached to the object, the arms pivot in a vertical plane about the pivot assembly; mounting means for attaching the pivot assemblies to the object; and means for locking the wheel assembly in a retracted position wherein the weight of the wheel assembly maintains the wheel assembly in the retracted position, and for locking the wheel assembly in an extended position wherein the weight of the object maintains the wheel assembly in the extended position.

A primary object of the invention is to provide an apparatus for moving objects over short distances that is easy to use.

Another object of the invention is to provide a retractable wheel assembly for moving objects that does not involve the removal or insertion or parts.

A still further object of the present invention is to provide a retractable wheel assembly for moving a picnic table over short distances.

DETAILED DESCRIPTION OF THE PREFERRED EMBODIMENT

Figure 1:
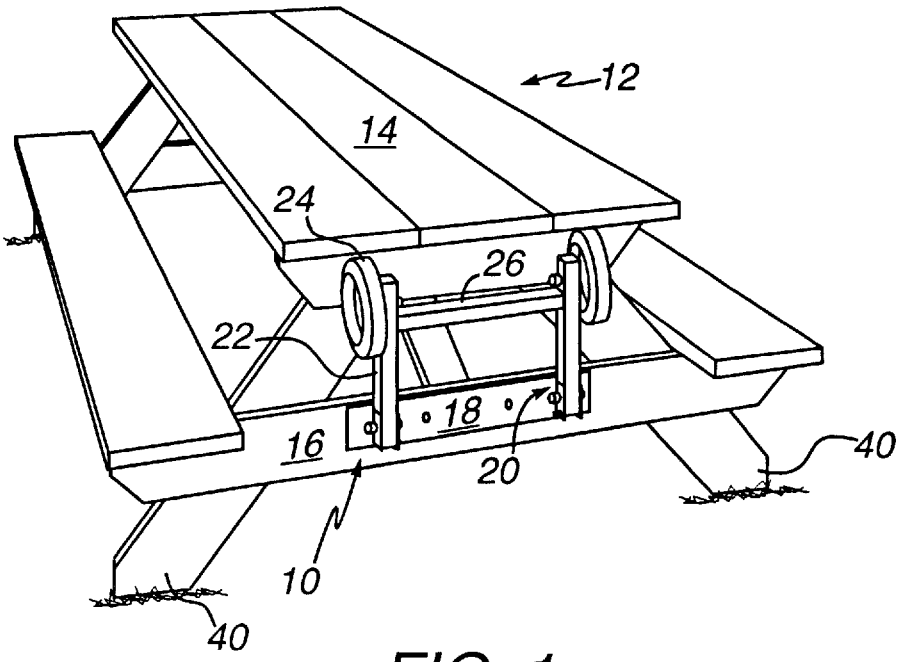
FIG. 1 is a perspective view of the wheel assembly in a retracted position attached to a conventional picnic table.
Figure 2:
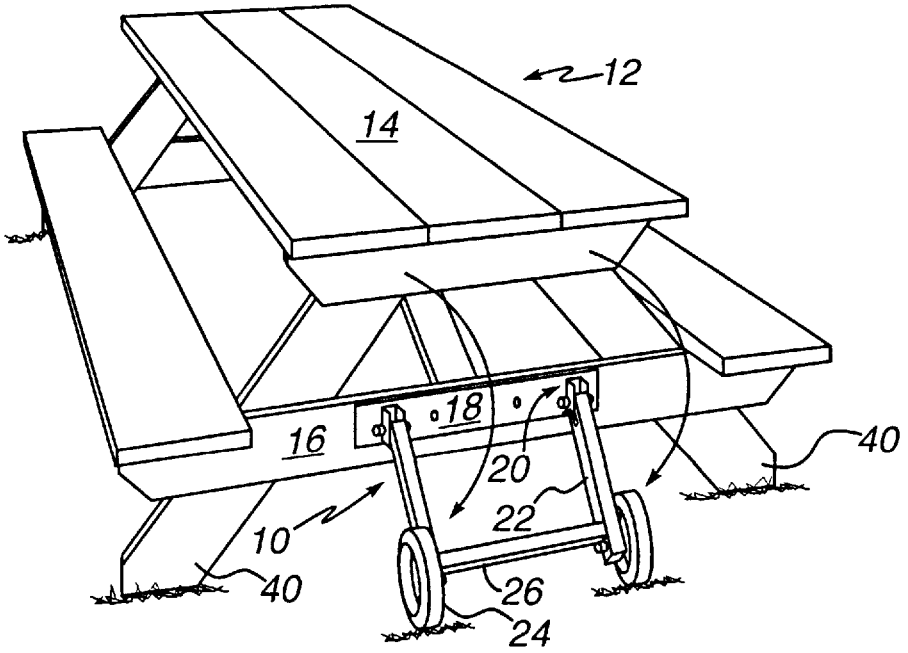
FIG. 2 is a perspective view of the wheel assembly in a semi-extended position.
Figure 2A:
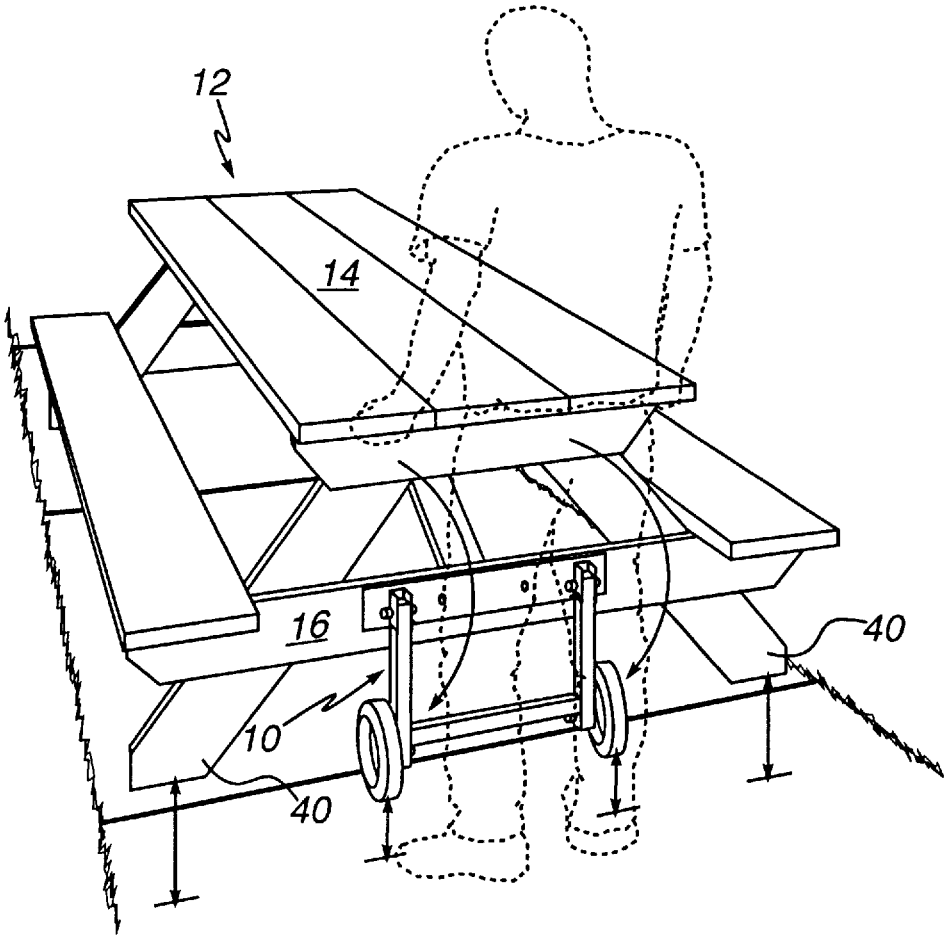
FIG. 2A is a perspective view of the wheel assembly before being locked in the extended position when the picnic table is lifted.

The retractable wheel assembly of the present invention can be attached to a vertical surface of any object. In one embodiment, as illustrated in FIG. 1, the assembly is attached to a vertical surface of a conventional picnic table. The retractable wheel assembly 10, attached to a picnic table 12 having a top horizontal surface 14 and a vertical side surface 16, comprises a mounting bracket 18, which is removably secured to the vertical side 16 of the table. To the bracket are mounted pivot assemblies 20. Attached to each pivot assembly is an arm 22 that pivots 180° in a vertical plane perpendicular to the mounting bracket. At the end of each arm is a wheel 24. A horizontal bar 26 passing through the center of all the wheels enables all the arms and the wheels to move together. The length of the arms is such that the when the wheel assembly is in a semi-extended position (FIG. 2), the wheels touch the ground. When the table is lifted from the side bearing the assembly, as illustrated in FIG. 2A, both the wheels 24 and the legs 40 are lifted off the ground with the wheels being closer to the ground than the legs. When the wheel assembly is locked in an extended position (FIG. 3), the table rests on the wheels and the legs 40 are lifted off the ground.

The pivot assembly 20 is shown in greater detail in FIGS. 4–8. Each arm 22 has an elongated slot 28 along its longitudinal axis close to one end. Each pivot assembly has a pair of flanges 30 oriented at right angles to the bracket 18 and welded thereto. Each flange has a through hole in its surface and a notch 32 at the bottom. The slotted end of the arm fits in between the two flanges of the pivot assembly and is slidably secured thereto by a bolt 34 through the hole and the slot 28. Each end of the bolt is secured to the flange by a nut (not shown). A pin 36 mounted to the arm is positioned on the longitudinal axis of the slot away from the end of the arm.

Figure 3:
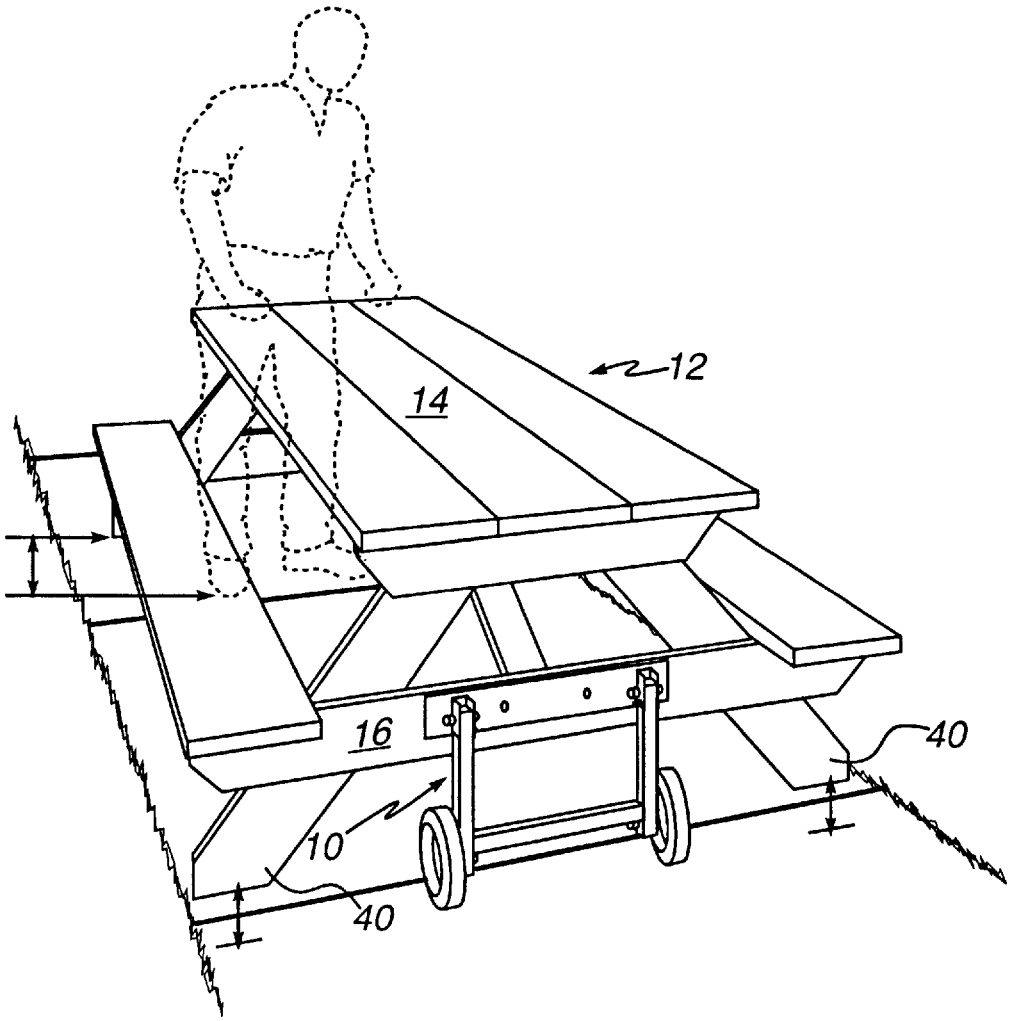
FIG. 3 is a perspective view of the wheel assembly locked in the extended position.
Figure 4:
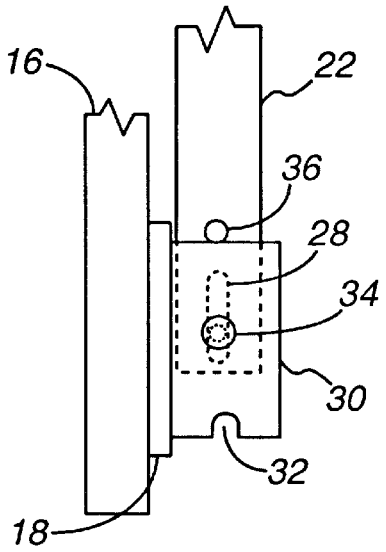
FIG. 4 is a side cut-away view of the pivot assembly showing the pivot assembly in the retracted position.
Figure 4A:
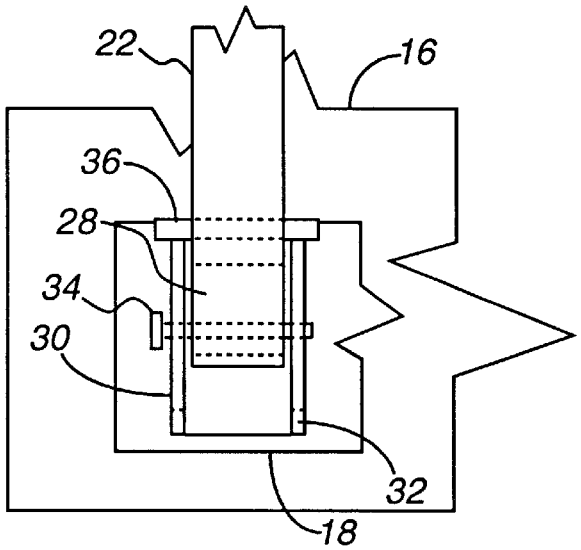
FIG. 4A is a front view of the pivot assembly showing the pivot assembly in the retracted position.
Figure 5:
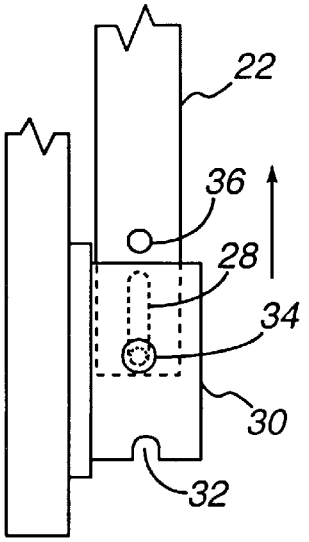
FIG. 5 is a side cut-away view of the pivot assembly when disengaging from the retracted position.
Figure 5A:
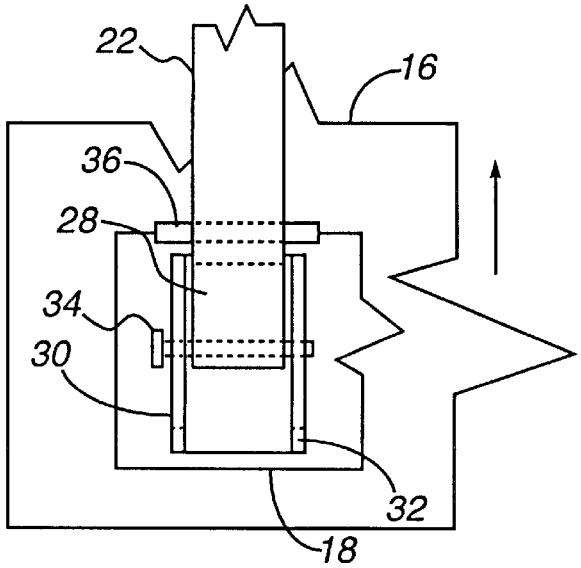
FIG. 5A is a front view of the pivot assembly when disengaging from the retracted position.
Figure 6:
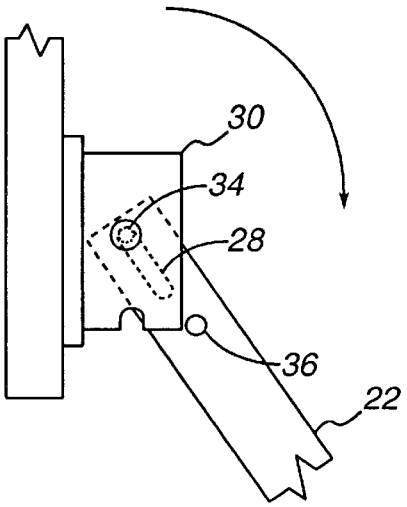
FIG. 6 is a side cut-away view of the pivot assembly during rotation of the arms along the pivot assembly.
Figure 6A:
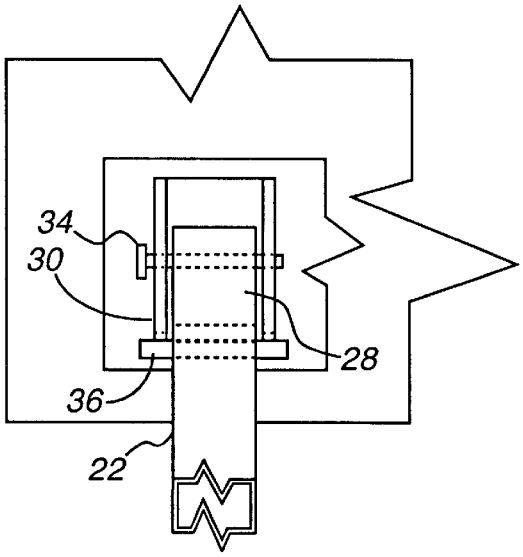
FIG. 6A is a front view of the pivot assembly during rotation of the arms along the pivot assembly.
Figure 7:
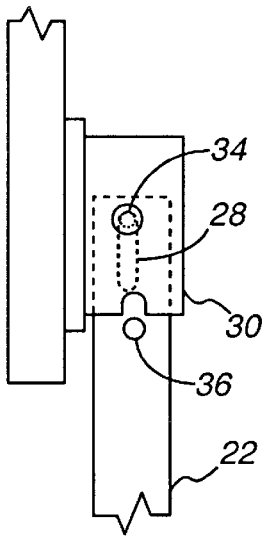
FIG. 7 is a side cut-away view of the pivot assembly in an extended position before the table is dropped on to the wheels.
Figure 7A:
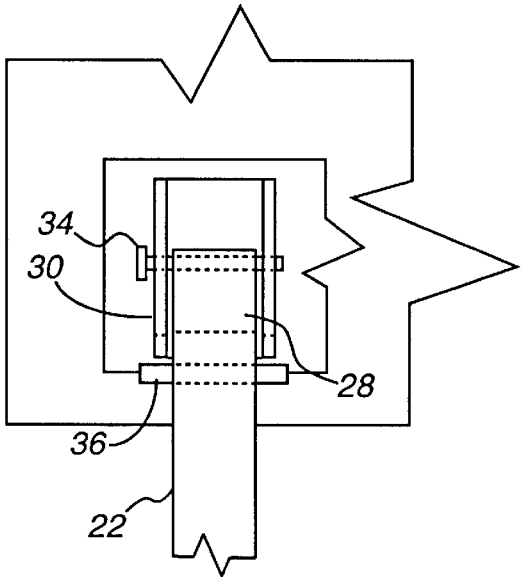
FIG. 7A is a front view of the pivot assembly in an extended position before the table is dropped on to the wheels.
Figure 8:
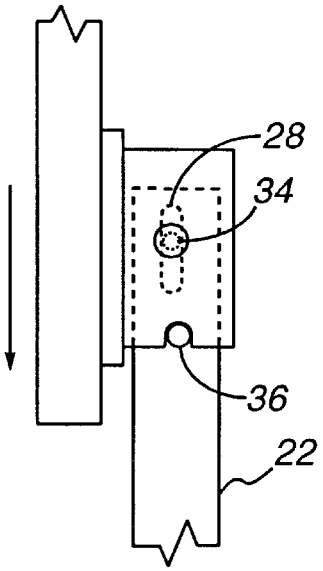
FIG. 8 is a side cut-away view of the pivot assembly locked in the extended position.
Figure 8A:
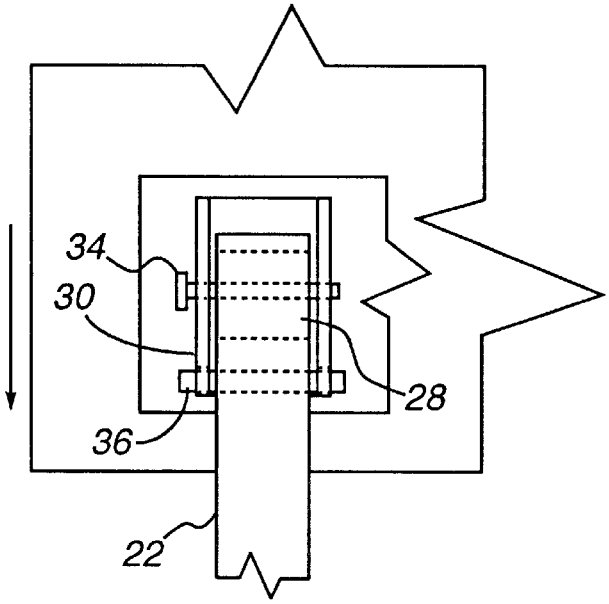
FIG. 8A is a front view of the pivot assembly locked in the extended position.

As shown in FIG. 1, the wheel assembly is capable of being stored in a retracted position under the top surface 14 of the picnic table when the wheels 24 are pivoted upwardly. In the retracted position, as illustrated in FIGS. 4 and 4A, the pin rests on the flanges 30 so that the arm is unable to rotate about the pivot assembly. As illustrated in FIGS. 5 and 5A, when the user lifts the arms, thereby sliding them along the slots upwardly around the bolts, the pins now will clear the edges of the flanges when the arms are rotated downwards about the pivot assemblies as illustrated in FIG. 6 and 6A. This enables the wheel assembly to be lowered into a semi-extended position such that the wheels are touching the ground (FIG. 2). With the wheels touching the ground and the arms approximately at a 45° angle to the bracket, as illustrated in FIG. 6, the table is lifted from the side to which the bracket is mounted (FIG. 2A) so that the weight of the wheel assembly forces the arms into a perpendicular orientation to the ground (FIG. 3 and 7). Before the table is lowered to the ground, as seen in FIGS. 7 and 7A, the bolt is flush with the top of the elongated slot. As the table is lowered to the ground, as seen in FIGS. 8 and 8A, the weight of the table pushes the bolt downwards along the slot in the arm. Further movement of the bolt along the slot is blocked by the pin 36 fitting into the notch 32 in the flange. The pins positioned within the notches prevent the arms from rotating, thereby locking them in the extended position. The table can now be lifted from the opposite side and moved backwards or forwards on the wheels. To unlock the wheel assembly from the extended position, the user has to simply lift the table from the side bearing the mounting bracket so that the pin slides out of the notch. With the wheels touching the ground, the user slightly pulls the arms thereby rotating the arms about the pivot assembly such that the pins are no longer aligned with the notches. The table is lowered to the ground to rest on its legs. The wheel assembly is now in a semi-extended position and the arms can be pivoted upwards back into the retracted position.

In another embodiment, wheel assemblies can be attached to each of the opposite sides of a table so that the table need not be lifted from one side for moving but can simply be rolled on the two wheel assemblies to the desired spot.

Figure 9:
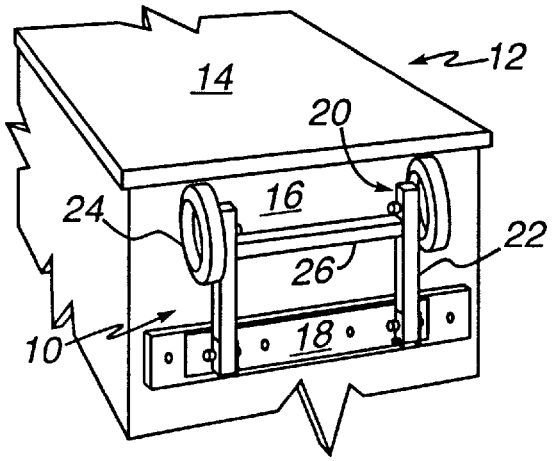
FIG. 9 is a perspective view of the wheel assembly attached to a generic surface.

Although the invention is described by reference to specific preferred embodiments, it is clear that as illustrated in FIG. 9, the invention can be used for moving any object that has a vertical surface for attaching the wheel assembly thereto. Preferably the top horizontal surface of the object hangs over the vertical side surface so that in its retracted position, the wheel assembly is tucked under the horizontal top surface and does not interfere with the use of the object and is not readily visible.

It is appreciated that various modifications to the inventive concepts described herein may be apparent to those skilled in the art without departing from the spirit of the present invention defined by the hereinafter appended claims.

What is claimed is:

1. A retractable wheel assembly for moving an object having a vertical surface for attachment of said wheel assembly, comprising:

a plurality of arms, each arm having a wheel at one end;

a plurality of pivot assemblies for receiving said arms such that when the pivot assemblies are attached to the object, the arms pivot in a vertical plane about the pivot assembly;

mounting means for attaching said pivot assemblies to said object; and means for locking said wheel assembly in a first retracted position wherein the weight of said wheel assembly maintains said wheel assembly in said first retracted position, and for locking said wheel assembly in a second extended position wherein the weight of said object maintains said wheel assembly in said second extended position.

2. The wheel assembly of claim 1, wherein, the pivot assemblies are mounted on a bracket adapted to be removably attached to the vertical surface of the said object.

3. The wheel assembly of claim 2, wherein the means for locking said wheel assembly in said first retracted position and said second extended position comprises:

a slot along the longitudinal axis of each arm;

a pair of flanges in each pivot assembly, perpendicular to the bracket, each flange having a hole and a notch at the bottom, one end of each arm fitting between the two flanges such that the slot in the arm is aligned with the hole in each flange;

a bolt across the holes in the flanges and the slot in the arm, such that the arm can rotate about the bolt in a vertical plane; and a pin mounted to the arm such that when the wheel assembly is in said first retracted position, the pin rests on the flanges and prevents the arm from rotating about the bolt thereby maintaining the wheel assembly in said first retracted position and when the wheel assembly is in said second extended position, the pin fits into the notch and prevents the arm from rotating about the bolt thereby maintaining the wheel assembly in said second extended position.

4. The wheel assembly of claim 1, further comprising a horizontal bar passing through the center of all the wheels such that all the arms and the wheels move together.

5. The wheel assembly of claim 1, wherein the object is a table.

6. The wheel assembly of claim 5, wherein the table is a picnic table.

* * * * *